US007267618B2

(12) United States Patent
Cohen

(10) Patent No.: US 7,267,618 B2
(45) Date of Patent: Sep. 11, 2007

(54) GOLF SWING TRAINING APPARATUS

(75) Inventor: Michael Jon Cohen, Orlando, FL (US)

(73) Assignee: Inside Right, Inc., Orlando, FL (US)

( * ) Notice: Subject to any disclaimer, the term of this patent is extended or adjusted under 35 U.S.C. 154(b) by 0 days.

(21) Appl. No.: 11/402,610

(22) Filed: Apr. 12, 2006

(65) Prior Publication Data

US 2006/0229138 A1 Oct. 12, 2006

Related U.S. Application Data

(60) Provisional application No. 60/670,545, filed on Apr. 12, 2005.

(51) Int. Cl.
*A63B 69/36* (2006.01)

(52) U.S. Cl. ..... 473/261; 473/257

(58) Field of Classification Search ..... 473/219, 473/257, 258, 26, 261, 262, 272, 273
See application file for complete search history.

(56) References Cited

U.S. PATENT DOCUMENTS

| | | | | |
|---|---|---|---|---|
| 4,322,084 | A * | 3/1982 | Reece et al. | 473/273 |
| 5,303,926 | A * | 4/1994 | Owens et al. | 473/261 |
| 6,695,709 | B1 * | 2/2004 | Ottensmeyer | 473/258 |
| 6,726,576 | B1 * | 4/2004 | Froggatte | 473/270 |

* cited by examiner

*Primary Examiner*—Nini F. Legesse
(74) *Attorney, Agent, or Firm*—James H. Beusse; Beusse Wolter Sanks Mora & Maire, P.A.

(57) ABSTRACT

A system for teaching proper takeaway of a golf club during a golf swing uses an apparatus having a sliding element for engaging a back of the golf club when the club is in a set-up position. The sliding element moves in a defined track in response to movement of the club towards a ball striking position. Movement of the sliding element while the club is in contact with it indicates the path of movement of the club.

4 Claims, 1 Drawing Sheet

GOLF SWING TRAINING APPARATUS

SPECIFIC DATA RELATED TO THE INVENTION

This application claims the benefit of U.S. provisional application No. 60/670,545, filed Apr. 12, 2005.

The present invention relates to a golf swing training device and more particularly, to a device for teaching a golfer the proper motion during initial takeaway of a golf club from the golf ball in preparation for a swing.

BACKGROUND OF THE INVENTION

One of the most important parts of the golf swing is the initial motion produced by the golfer when taking a club away from the golf ball in preparation for making a down swing. Many persons attempting to strike a golf ball tend to lift the club in an upward motion thereby promoting an early break in the wrist position which results in a setup for a golf swing that detrimentally affects the angle with which the club strikes the ball when completing the swing. While golfers are aware that the club should be taken away in substantially a flat plane using the arms and shoulders rather than the wrists, teaching such proper takeaway of a golf club is difficult. The present invention provides a device which encourages the proper initial takeaway of the golf club to better allow the golfer to set the club in the proper position for a down swing.

DETAILED DESCRIPTION OF THE INVENTION

Figure 1:
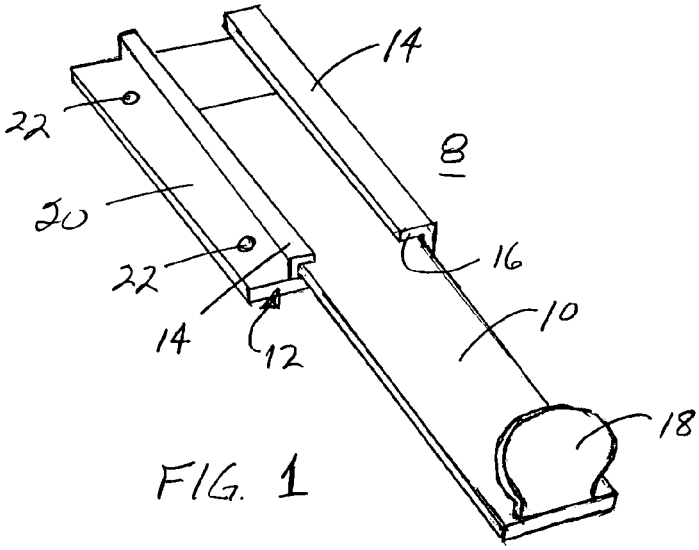
FIG. 1 is a perspective view of one form of the present invention.
Figure 2:
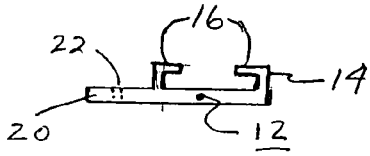
FIG. 2 is an end view of the stationary element of the form of the invention shown in FIG. 1.
Figure 3:
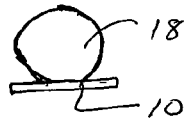
FIG. 3 is an end view of the sliding element of FIG. 1.

Referring to FIG. 1, there is shown a perspective view of one form of the present inventive device 8 comprising a first slidable strip-like member 10 which slides within a stationary support member 12. The support member 12 has a pair of upright side elements or flanges 14, shown in cross-section in FIG. 2, which have overlapping ends 16 that capture the sliding member 10. The sliding member 10 is provided with a vertically extending element 18. An end view of the sliding member 10 is shown in FIG. 3. Element 18 may be molded as part of member 10 or may be a separate element releasably attachable to member 10 by means well known in the art. The detachable element 18 is preferred for packaging. The member 12 is also provided with a flange or side extension 20 in which there may be provided holes 22 to enable the member 12 to be fixed in position on the ground by driving gutter nails, tees or similar devices through the holes 22.

Figure 4:
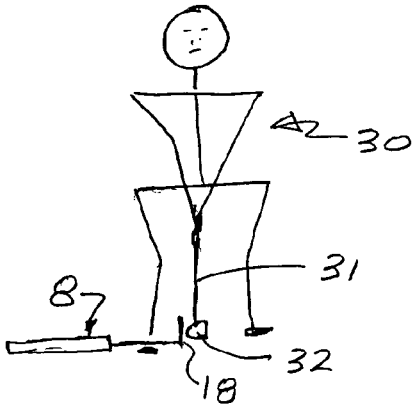
FIG. 4 illustrates a start position for a golfer using the insertion of FIG. 1.

As can be seen from FIG. 1, the element 10 slides on top of and within the confined slot defined by the member 12 and the side pieces 14. In operation, the member 10 is extended in the form shown in FIG. 1 and the golfer 30 is set up with a golf club 31 positioned so that the back of the club head 32 is positioned against the vertical element 18 as shown in FIG. 4. For a proper takeaway of the golf club, the golfer would start moving the club backward such that the sliding member 10 in contact with the club head slides smoothly within the slotted area defined on the member 12. If the club is properly taken away, the member 10 will slide a predetermined distance before the club head raises above the level of the vertical element 18. By concentrating on achieving this desired amount of sliding of the element 10, the golfer will learn how to take the golf club back so that the club head is taken away with the arms and shoulders rather than being lifted by the hands and wrists. By repetitive use of this device, a golfer can achieve muscle memory and be comfortable in making a proper takeaway of the golf club. The device 8 may also identify a takeaway motion that transitions inside or outside a desired takeaway path. Further, since the takeaway motion pushes the movable element 10 out of the swing path, the golfer can complete a full swing by making a down-swing to a ball. Such action encourages a slower, deliberate takeaway, and there are benefits for the down-swing, teaching "drag".

The device illustrated in FIG. 1 can be created out of plastic material of the type providing a smooth sliding interface between the elements or members 10 and 12. As shown in FIG. 3, a typical width of the member 10 is about five inches while the height of the element 18 is about 3¾ inches. The members 10 and 12 may be formed from about ¼ inch thick material.

What is claimed is a golf swing training device comprising a first member for sliding within a second member while the second member is placed on substantially flat surface, the first member having a vertical element extending from one end thereof for engaging the back side of a golf club when a golfer is set in a golfing position, the member sliding within the second member when the golfer takes away the club in a proper swing plane.

What is claimed is:

1. A golf swing training apparatus for teaching proper takeaway of a golf club by a golfer comprising:

a first elongate stationary member aligned with but out of a golf club swing path;

a second elongated movable member slidingly coupled to the stationary member and having an end element for contacting a back of a golf club head when a golfer positions a golf club into a swing set up position, the second movable member having an elongate configuration aligned with an elongate direction of the first stationary member such that the moveable member slides along the stationary member and is pushed out of the golf swing path in response to the golf club being moved in a takeaway motion.

2. The golf swing training apparatus of claim 1 wherein the second movable member comprises a relatively thin, elongate strip.

3. The golf swing training apparatus of claim 2 wherein the first stationary member comprises an elongate plate having opposite edges terminating in flanges extending lengthwise of the plate, the flanges having return portions for capturing the second movable member.

4. The golf swing training apparatus of claim 3 wherein the end element comprises a generally circular plate attached to the second movable member.

* * * * *